US006239726B1

(12) United States Patent
Saida

(10) Patent No.: US 6,239,726 B1
(45) Date of Patent: May 29, 2001

(54) PUSHBUTTON ARRANGEMENT

(75) Inventor: Yoshihide Saida, Shizuoka (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/179,131

(22) Filed: Oct. 26, 1998

(30) Foreign Application Priority Data

Oct. 27, 1997 (JP) ..... 9-294579

(51) Int. Cl.[7] ..... G08B 1/123

(52) U.S. Cl. ..... 340/999; 340/407.1; 340/393.3; 379/368; 379/369; 379/370; 200/341; 200/344; 200/345; 341/20; 341/22; 341/27

(58) Field of Search ..... 340/407, 393.3, 340/311.1, 999; 379/368, 369, 370; 200/341, 344, 345, 520; 341/20, 22, 27

(56) References Cited

U.S. PATENT DOCUMENTS

| | | | | |
|---|---|---|---|---|
| 4,386,240 | * | 5/1983 | Philipp et al. | 179/90 K |
| 5,172,990 | * | 12/1992 | Weng | 400/490 |
| 5,203,448 | * | 4/1993 | Osada et al. | 200/517 |
| 5,638,351 | * | 6/1997 | Kanada et al. | 369/77.2 |
| 5,819,914 | * | 10/1998 | Yoneyama | 200/344 |
| 5,833,491 | * | 11/1998 | Suzuki | 439/500 |
| 5,887,704 | * | 3/1999 | Schorpp et al. | 200/296 |

FOREIGN PATENT DOCUMENTS

| | | |
|---|---|---|
| 58-31633 | 8/1981 | (JP) . |
| 58-33634 | 7/1983 | (JP) . |
| 62-76437 | 5/1987 | (JP) . |
| 63-178024 | 11/1988 | (JP) . |
| 8-222073 | 8/1996 | (JP) . |
| 8-235959 | 9/1996 | (JP) . |
| 8316664 | 11/1996 | (JP) . |

OTHER PUBLICATIONS

Japanese Office Action issued Aug. 24, 1999 in a related application.
English translation of the relevant portions of the Aug. 24, 1999 Japanese Office Action.

* cited by examiner

*Primary Examiner*—Daniel J. Wu
*Assistant Examiner*—Tai T. Nguyen
(74) *Attorney, Agent, or Firm*—Ostrolenk, Faber, Gerb & Soffen, LLP

(57) ABSTRACT

A pushbutton arrangement includes a pushbutton switch mounted on a substrate and the pushbutton switch has an actuating position. The pushbutton arrangement further includes a supporting member fixed to the substrate and a button operation member for pushing the actuating portion of the pushbutton switch. An elastic connection member is fixed to the supporting member at one end thereof and has the button operation member fixed at the other end thereof so that the button operation member is placed on the actuating portion of the pushbutton switch.

20 Claims, 4 Drawing Sheets

PUSHBUTTON ARRANGEMENT

BACKGROUND OF THE INVENTION

1. Field of the Invention

The present invention relates to an electronic apparatus having a pushbutton switch therein, such as a radio selective call receiver, radiotelephone equipment or the like and in particular to a pushbutton arrangement of the pushbutton switch for performing various kinds of operation.

2. Description of Related Art

A pushbutton arrangement installed in an electronic apparatus is generally structured by a switch part, a printed substrate onto which the switch part is fixedly provided and a pushbutton for operating the switch part.

There have recently been required a pushbutton arrangement that provides an operator with an improved feeling of a click of a button when it is depressed and that ensures a secure switching operation. A pushbutton arrangement that meets this demand has been proposed in Japanese Patent Application Laid-open Publication No. 8-316664.

According to this conventional pushbutton arrangement, a printed substrate fixedly mounted with a switch part on it is fixed to a case by a pair of engagement bosses and ribs. Therefore, a depression of a button to operate a switch part does not cause a deflection of the printed substrate and thus this makes it possible to obtain a hard click feeling with a secure switching operation.

However, according to this conventional pushbutton arrangement, since the button is not fixedly engaged with other members, it is not possible to maintain a constant distance between the button and the switch part. Accordingly, a sufficiently satisfactory click feeling cannot always be obtained and a secure switching operation cannot be ensured.

Further, in case the conventional pushbutton arrangement is used for a radio selective call receiver or a portable telephone that employs a vibration generated by a motor for reporting an arrival of a call, the button becomes resonant with the vibration generated and this causes an interference noise to be generated between the button and the case or between the button and the switch part, because the button is not fixedly engaged with the other members as described above.

Furthermore, according to the conventional pushbutton arrangement, as the button is not fixedly engaged with the other members, the button is dropped easily at the time of assembling the pushbutton arrangement, which lowers the productivity with a resultant increase in manufacturing cost.

SUMMARY OF THE INVENTION

With a view to eliminating the above problems, it is an object of the present invention to provide a pushbutton arrangement which makes it possible to obtain a satisfactory click feeling of a button, ensures a secure switching operation.

It is another object of the present invention to provide a pushbutton arrangement which prevents a generation of an interference noise of the button due to vibration.

It is still another object of the present invention to provide a pushbutton arrangement, which makes it easy to produce it and lowers the manufacturing cost.

According to the present invention, a pushbutton arrangement includes a pushbutton switch mounted on a side of a substrate, the pushbutton switch having an actuating portion to which an external force is applied to do switch operation. The pushbutton arrangement further includes a supporting member fixed to the substrate on the same side as the pushbutton switch mounted and a button operation member for pushing the actuating portion of the pushbutton switch. An elastic connection member is fixed to the supporting member at one end thereof and has the button operation member fixed at the other end thereof so that the button operation member is placed on the actuating portion of the pushbutton switch.

A force caused by the elastic connection member is being applied to the button operation member in a predetermined direction. The force may be applied to the button operation member toward the pushbutton switch and movement of the button operation member is stopped by the actuating portion of the pushbutton switch. Alternatively, a stopper may be provided for stopping the button operation member moving in the predetermined direction.

The pushbutton arrangement preferably includes an engagement mechanism for engaging the supporting member with the substrate. The elastic connection member may connect the supporting member with the button operation member in a slope in such a way that the button operation member is kept away from the substrate and the supporting member is connected to the substrate by the engagement mechanism. Alternatively, the elastic connection member may connect the supporting member with the button operation member a way that the button operation member comes close to the substrate and the supporting member is connected to the substrate by the engagement mechanism.

DETAILED DESCRIPTION OF THE PREFERRED EMBODIMENTS

Taking a radio selective call receiver as an example, embodiments of the present invention will be explained below.

First Embodiment

Figure 1:
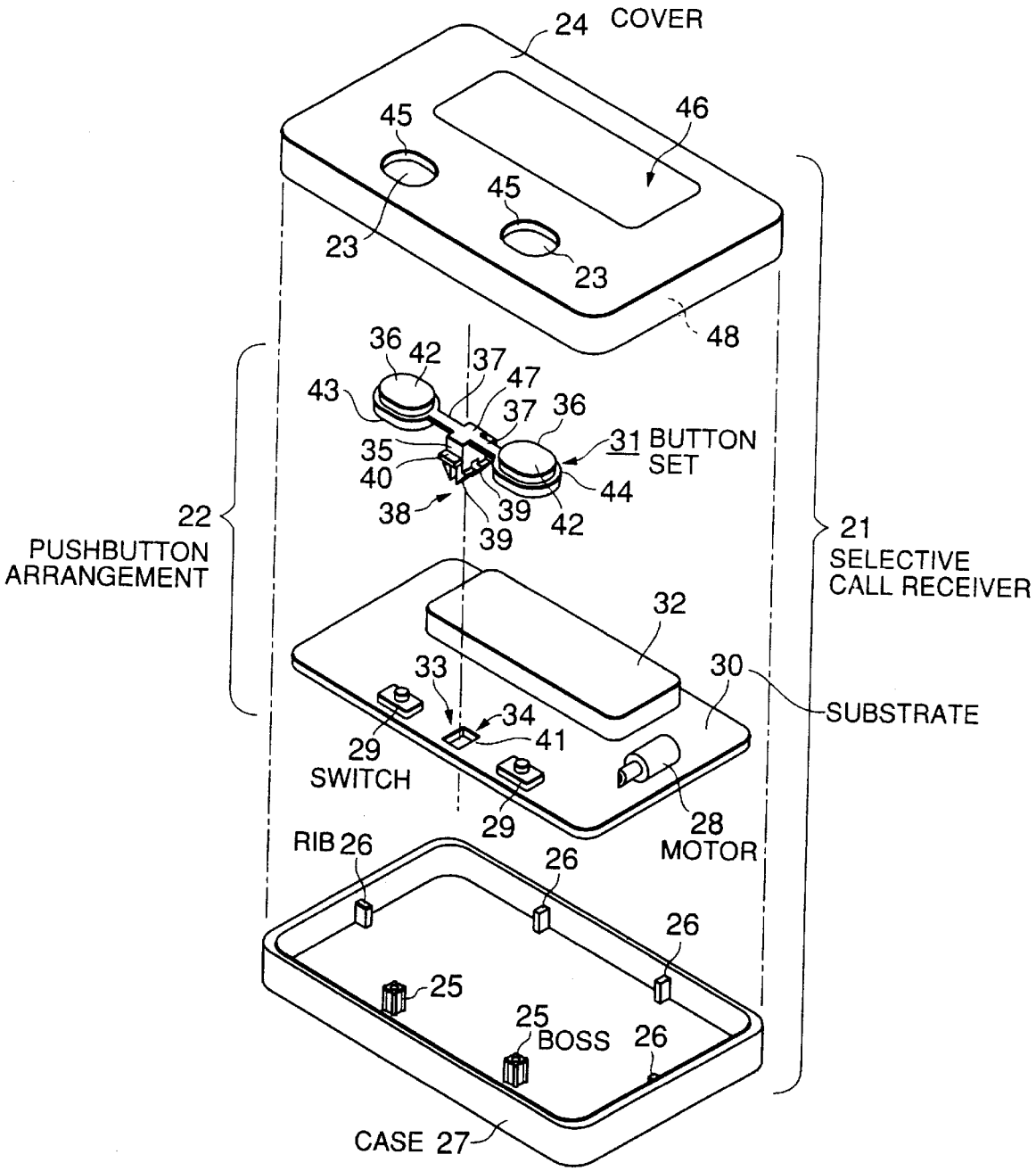
FIG. 1 is a breakdown perspective view for explaining an example that a pushbutton arrangement according to a first embodiment of the present invention is used for a radio selective call receiver.
Figure 2:
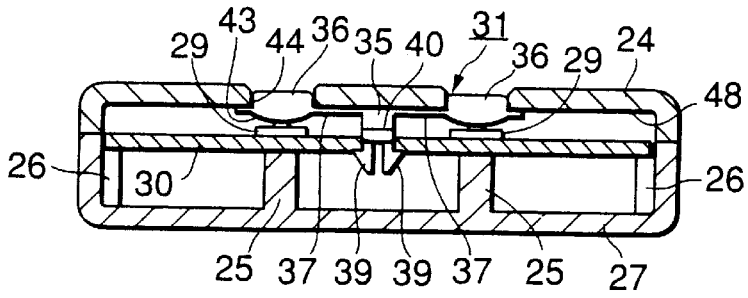
FIG. 2 is a cross-sectional view for explaining the example that the pushbutton arrangement according to the first embodiment of the present invention is used for a radio selective call receiver.

Feferring to FIGS. 1 and 2, a radio selective call receiver 21 is provided with a pushbutton arrangement 22. In the radio selective call receiver 21, there are provided a box-shaped cover 24 and a box-shaped case 27 which are engaged to form a casing of the radio selective call receiver 21, where a substrate 30 mounted with the pushbutton arrangement 22 is contained and placed. The box-shaped cover 24 is provided with a pair of holes 23 and 23 through which button operation sections 36 are operable, respectively. The box-shaped case 27 has bosses 25 and ribs 26 formed on the inner surface thereof. The bosses 25 and ribs 26 cause the substrate 30 to be placed. Especially, the bosses 25 are provided to support the substrate 30 at the positions of a pair of switch parts 29 mounted on the substrate 30. In addition to the switch parts 29, the substrate 30 mounts a motor 28 for informing a user of an incoming call by vibration.

Each of the switch parts 29 may be any kind of pushbutton-type switch such as a momentary action switch or maintained action switch having an actuating portion to which an external force is applied to operate the switch. In FIGS. 1 and 2, a small protrusion on the top of each switch part 29 is the actuating portion. As described later, when an operator pushes a button operation section 36, the actuating portion of the corresponding switch part 29 is moved to make contact.

The pushbutton arrangement 22 is structured by the switch parts 29, the substrate 30, and a button set 31 for operating the switch parts 29. On the substrate 30, there are disposed the switch parts 29 and 29, circuits (not shown) necessary for operating the radio selective call receiver 21, a display section 32 such as a liquid crystal display for displaying necessary operation information, and the motor 28. On the substrate 30, there is formed an engagement section 33 for engaging and fixing the button set 31 between the two switch parts 29.

In the case of the first embodiment as shown in FIGS. 1 and 2, an engagement hole 34 is formed as the engagement section 33. The respective switch parts 29 are fixed at positions corresponding to bottom surfaces of the button operation sections 36. A type of the switch parts 29 is not particularly limited, and push-button switch parts can be used.

The button set 31 is structured by a supporting pillar 35 fixed to the substrate 30, the pair of button operation sections 36 and 36 for depressing the switch parts 29, and a pair of connection rods 37 and 37 made of an elastic member for connecting the supporting pillar 35 with the pair of button operation sections 36 and 36, each of the connection rods 37 being bent when the corresponding button operation section 36 is depressed. At a lower portion of the supporting pillar 35, an engagement section 38 is formed for engagement with the substrate 30.

The engagement section 38 is formed with a key-claw shaped projection 39 and a convex projection 40 for making an engagement with the engagement section 33. When the key-claw shaped projection 39 is pierced through the engagement hole 34, the convex projection 40 butts against an edge 41 of the engagement hole 34 so that the edge 41 of the engagement hole 34 is sandwiched between the key-claw shaped projection 39 and the convex projection 40, thus ensuring an engagement between the engagement section 38 of the button set 31 and the engagement section 33 of the substrate 30, and the button set 31 is fixed to the substrate 30. A cross section of the supporting pillar 35 is formed to coincide with the shape of the engagement hole 34.

Each of the button operation sections 36 is formed with an upper surface 42 to be depressed by an operator, a bottom surface 43 for depressing the switch part 29, and a flange 44 that is stopped at an edge 45 of the button hole 23, for restricting a position of the button operation section 36.

The connection rods 37 of an elastic member may be made of any material, which allows the rod 37 to be bent when the button operation section 36 corresponding to this rod 37 is depressed. For example, both the button operation sections 36 and the supporting pillar 35 may be formed in one integration with the same resin such as ABS resin. Alternatively, the connection rods 37 may be formed by leaf springs or the like.

The bosses 25 are provided in projection on the case 27 toward the opening side of the case 27 at positions corresponding to the switch parts 29 fixed to the substrate 30. The ribs 26 are formed on an inner wall of the case 27 to have an equivalent height to that of the bosses 25. The cover 24 is provided with a display window 46 through which the display section 32 pierces.

Further, the pushbutton arrangement 22 is so structured that an upper surface 47 of the supporting pillar 35 and a bottom surface 48 of the cover 24 are brought into contact with each other when the cover 24 and the case 27 are engaged together.

According to the above-described pushbutton arrangement 22, it is possible to keep a constant distance between the button operation sections 36 and the switch parts 29 without causing a loosening of the button 31 with respect to the substrate 30, by virtue of the above-described features that the button set 31 and the substrate 30 are firmly fixed by the engagement between the engagement sections 38 and 33, that the shape of the cross section of the supporting pillar 35 coincides with the shape of the engagement hole 34, and that the upper surface 47 of the supporting pillar 35 and the bottom surface 48 of the cover 24 are brought into contact with each other. Further, even if a load is applied to a portion of the cover 24 between the pair of button holes 23 and 23, this does not work to depress any one of the button operation sections 36 as the cover is not deflected by this load, so that a malfunction of the switch parts 29 can be prevented. Further, it never happens that the button set 31 is dropped from the substrate 30 at the time of assembling the pushbutton arrangement 22 as the button set 31 has been fixed to the substrate in advance at the time of manufacturing the pushbutton arrangement 22. This improves the productivity and lowers the manufacturing cost.

Figure 6B:
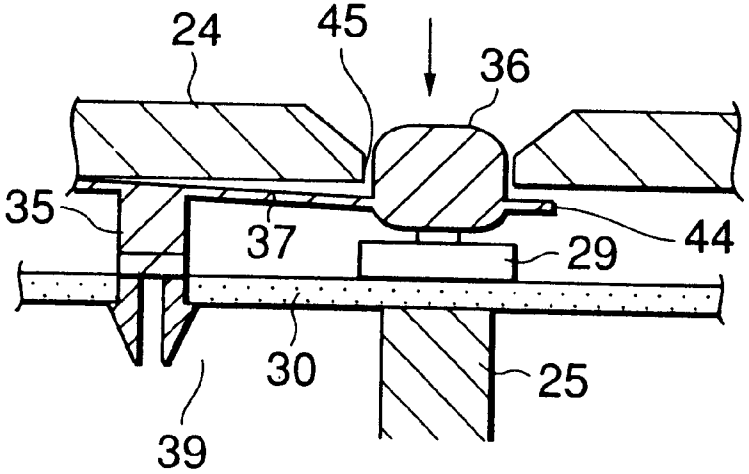
FIG. 6B is a cross-sectional view showing a pushed state of the pushbutton arrangement according to the first embodiment.
Figure 6A:
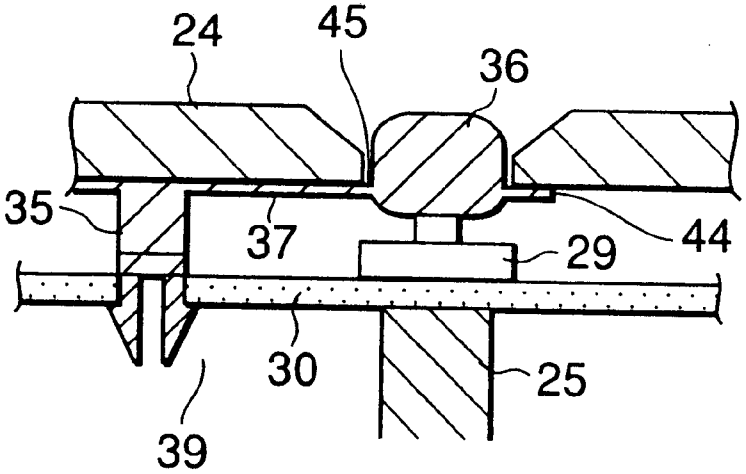
FIG. 6A is a cross-sectional view showing a normal state of a pushbutton arrangement according to the first embodiment.

Further, according to the above-described pushbutton arrangement 22, as shown in FIGS. 6A and 6B, a depression of any one of the button operation sections 36 provides a hard click feeling without causing a deflection of the substrate 30, by virtue of the fact that the substrate 30 fixed with the switch parts 29 is fixed to the case 27 by keeping a constant distance between the substrate 30 and the bottom surface of the case 27 by the bosses 25 and the ribs 26, particularly with the bosses 26 being provided in projection at positions corresponding to the switch parts 29.

Furthermore, according to the above-described pushbutton arrangement 22, a depression of any one of the button operation sections 36 provides a satisfactory feeling of depression, by virtue of the fact that the connection rods 37 made of an elastic member are provided in the button section 31 to permit a bending of the rod 37 when the corresponding button operation section 36 is depressed as shown in FIG. 6B.

Second Embodiment

Figure 3:
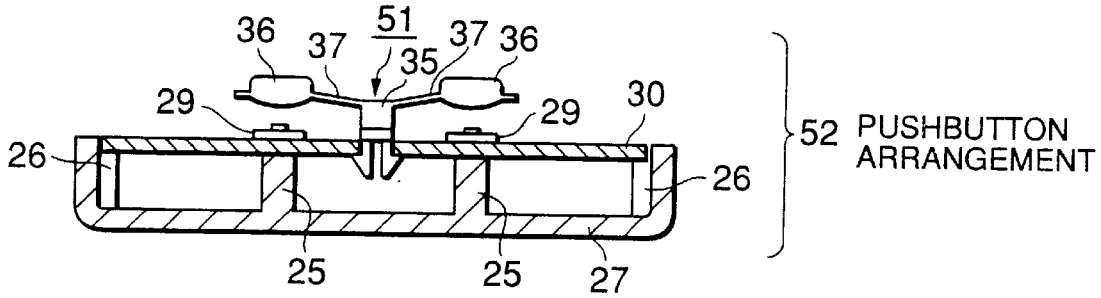
FIG. 3 is a cross-sectional view for explaining an example that a pushbutton arrangement according to a second embodiment of the present invention is used for a radio selective call receiver.

FIG. 3 is a cross-sectional view of a pushbutton arrangement 52 to be used in a radio selective call receiver, for explaining the second embodiment, wherein members similar to those previously described with reference to FIGS. 1 and 2 are denoted by the same reference numerals. In the second embodiment, only differences from the above first embodiment will be explained.

As shown in FIG. 3, a pushbutton arrangement 52 is provided with a button set 51 having the connection rods 37 for connecting the supporting pillar 35 with the button operation sections 36 in a slope in such a way that the button operation sections 36 are kept away from the substrate 30.

In this pushbutton arrangement 52, as shown in FIGS. 6A and 6B, the flanges 44 of the button operation sections 36 are brought into contact with the edges 45 of the button holes 23 and thereby the button operation sections 36 are pressed toward the substrate 30 by the cover 24 so that the connection rods 37 are elastically deformed. This causes a fine load to be applied to the edges 45 of the button holes 23 from the button operation sections 36, and the button operation section 36 are closely adhered to the edges 45 of the button holes 23.

As the above-described pushbutton arrangement 52 includes the connection rods 37 slanted in such a way that the button operation sections 36 are kept way from the substrate 30, it becomes possible to closely adhere the flanges 44 of the button operation sections 36 to the edges 45 of the button holes 23, as shown in FIG. 6A. Therefore, even if an oscillation generated by the operation of the motor 28 is applied to the substrate 30, the button set 51 is not resonated with this oscillation and a generation of an interference noise between the button set 51 and the cover 24 can be prevented.

Third Embodiment

Figure 4:
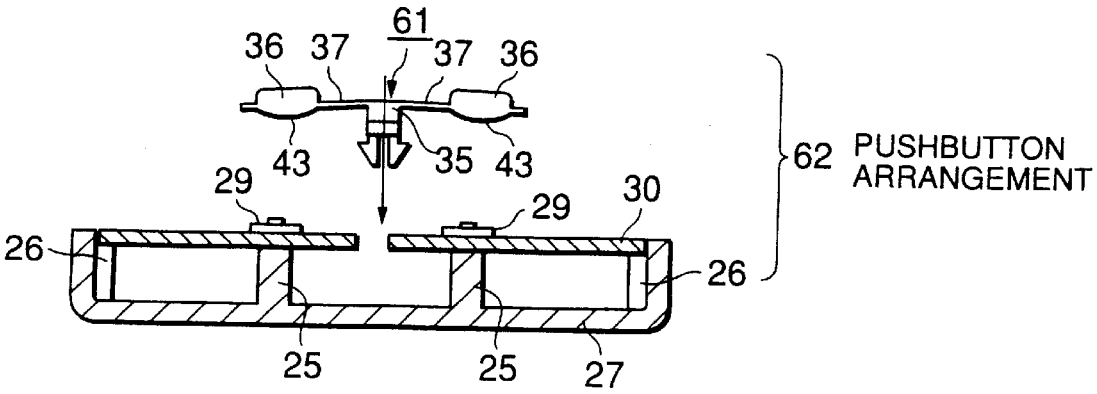
FIG. 4 is a cross-sectional view for explaining an example that a pushbutton arrangement according to a third embodiment of the present invention is used for a radio selective call receiver.

FIG. 4 is a cross-sectional view of a pushbutton arrangement 62 to be used in a radio selective call receiver, for explaining the third embodiment, wherein members similar to those previously described with reference to FIGS. 1 and 2 are denoted by the same reference numerals. In the third embodiment, only differences from the above first and second embodiments will be explained.

As shown in FIG. 4, the pushbutton arrangement 62 is provided with a button set 61 having the connection rods 37 for connecting the supporting pillar 35 with the button operation sections 36 in a slope in such a way that the button operation sections 36 come close to the substrate 30. In this pushbutton arrangement 62, the bottom surfaces 43 of the button operation sections 36 are brought into contact with the switch parts 29, the button operation sections 36 are pressed by the switch parts 29 so that the connection rods 37 are elastically deformed, a fine load is applied to the switch parts 29 from the button operation sections 36, and the button operation sections 36 are closely adhered to the switch parts 29.

As the above-described pushbutton arrangement 62 includes the connection rods 37 slanted in such a way that the button operation sections 36 come close to the substrate 30, it becomes possible to closely adhere the bottom surfaces 43 of the button operation sections 36 to the switch parts 29. Therefore, even if an oscillation generated by the operation of the motor 28 is applied to the substrate 30, the button set 61 is not resonated with this oscillation and a generation of an interference noise between the button set 61 and the switch parts 29 can be prevented.

Fourth Embodiment

Figure 5:
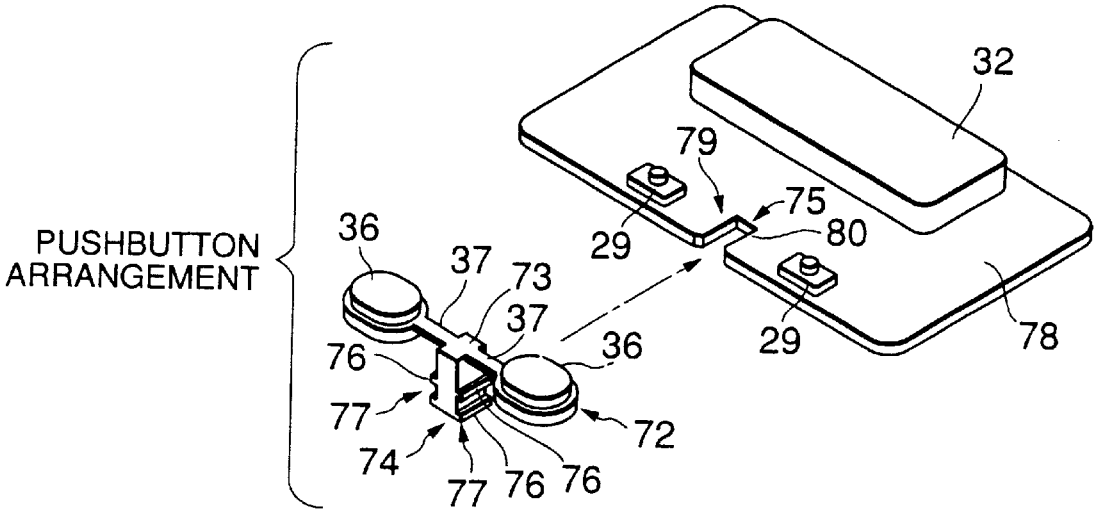
FIG. 5 is a breakdown perspective view for explaining an example that a pushbutton arrangement according to a fourth embodiment of the present invention is used for a radio selective call receiver.

FIG. 5 is a perspective view of a pushbutton arrangement 71 to be used in a radio selective call receiver, for explaining the fourth embodiment, wherein members similar to those previously described with reference to FIGS. 1 and 2 are denoted by the same reference numerals. In the fourth embodiment, only differences from the above first embodiment will be explained.

Referring to FIG. 5, in an engagement section 74 of the pushbutton arrangement 71, there are provided four block-shaped projections 76 for making an engagement with an engagement section 75. There are two U-shaped recesses 77 formed between the two adjacent block-shaped projections 76.

A substrate 78 of this pushbutton arrangement 71 is formed with a recess section 79 provided by cutting a side of the substrate 78 as the engagement section 75. For fixing a button set 72 to the substrate 78, the U-shaped recesses 77 of the engagement section 74 are engaged with an edge 80 of the recess section 79 of the engagement section 75 so that the edge 80 of the recess section 79 is sandwiched between the two block-shaped projections 76.

According to the above-described pushbutton arrangement 71, a manufacturing cost of the pushbutton arrangement 71 can be made lower by virtue of the fact that the pushbutton arrangement 71 includes the engagement section 74 formed with the four block-shaped projections 76 and the engagement section 75 having the recess section 79 and thus facilitating a forming a simple structure of the engagement sections 74 and 75.

The technical range of the present invention is not limited to the above-described embodiments, but there may be various modifications to this range within the scope of the present invention. For example, although the substrate is fixed by the bosses and ribs in the above-described embodiments, it is also good to arrange such that a key-claw shaped projection is provided on the cover, an engagement hole is provided on the substrate, and the substrate is fixed by engaging the key-claw shaped projection with the engagement hole.

Further, although the engagement sections are formed on the button set and on the substrate respectively to engage these sections for fixing the button set to the substrate according to the pushbutton arrangement of the present invention, both the substrate and the button set may also be fixed by using an adhesive or the like. Alternatively, the substrate and the button set may be welded together. As a further alternative, the substrate and the button set may be formed in one integration.

While description has been made of the case in the above that the button set is formed with a pair of button operation sections, the pushbutton arrangement of the present invention is not limited to this but the button set may be formed with one or more button operation sections.

The pushbutton arrangement of the present invention is suitable for a portable electric application such as a radio selective call receiver or a portable telephone. However, it can also be applied to other electronic apparatuses.

As explained in detail in the above, the pushbutton arrangement of the present invention includes switch parts, a substrate fixed with the switch parts and a button set for operating the switch parts. Further, the substrate is supported by bosses at positions of the switch parts. Furthermore, the button set includes a supporting pillar fixed to the substrate, button operation sections for depressing the switch parts, and connection rods made of an elastic member for connecting the supporting pillar and the button operation sections and for being bent when the button operation sections are depressed.

Accordingly, the button set is not loosely fitted to the substrate, a hard click feeling can be obtained and a secure switching operation can be ensured. Further, the button set will not drop at the time of manufacturing the pushbutton arrangement, thus leading to an improved productivity and a lower manufacturing cost.

Further, according to another aspect of the pushbutton arrangement of the present invention, the button set includes connection rods for connecting the button operation sections with the supporting pillar in such a way that the button operation sections are kept away from or are brought close to the substrate. Accordingly, it becomes possible to keep a close adhesion between the button operation sections and the cover set or between the button operation sections and the switch parts. Therefore, even if an oscillation generated by the motor is applied to the substrate at the time of an incoming of call, the button set is not resonated with this oscillation and thus, it becomes possible to prevent a generation of an interference noise between the button set and the cover or between the button set and the switch parts.

I claim:

1. A pushbutton arrangement provided in an electric apparatus, comprising:

a pushbutton switch mounted on a side of a substrate, the pushbutton switch having an actuating portion to which an external force is applied to do switch operation;

a supporting member fixed to the substrate on the same side as the pushbutton switch mounted;

a button operation member for pushing the actuating portion of the pushbutton switch; and an elastic connection member fixed to the supporting member at one end thereof and having the button operation member fixed at the other end thereof so that the button operation member is placed on the actuating portion of the pushbutton switch.

2. The pushbutton arrangement according to claim 1, wherein a force caused by the elastic connection member is being applied to the button operation member in a predetermined direction.

3. The pushbutton arrangement according to claim 2, wherein the force is applied to the button operation member toward the pushbutton switch and movement of the button operation member is stopped by the actuating portion of the pushbutton switch.

4. The pushbutton arrangement according to claim 2, further comprising:

a stopper for stopping the button operation member moving in the predetermined direction.

5. The pushbutton arrangement according to claim 1, further comprising:

an engagement mechanism for engaging the supporting member with the substrate.

6. The pushbutton arrangement according to claim 5, wherein the elastic connection member connects the supporting member with the button operation member in a slope in such a way that the button operation member is kept away from the substrate and the supporting member is connected to the substrate by the engagement mechanism.

7. The pushbutton arrangement according to claim 5, wherein the elastic connection member connects the supporting member with the button operation member a way that the button operation member comes close to the substrate and the supporting member is connected to the substrate by the engagement mechanism.

8. The pushbutton arrangement according to claim 5, wherein the engagement mechanism comprises:

a key-claw shaped projection and a convex projection provided in the supporting member; and an engagement hole formed in the substrate, wherein the key-claw shaped projection is pierced through the engagement hole and the convex projection butts against an edge of the engagement hole so that the edge of the engagement hole is sandwiched between the key-claw shaped projection and the convex projection.

9. The pushbutton arrangement according to claim 5, wherein the engagement mechanism comprises:

an engagement recess provided by cutting a side of the substrate; and a pair of recesses formed on opposite sides of the supporting member so that the recesses of the supporting member can be engaged with the engagement recess of the substrate by sliding the supporting member into the engagement recess.

10. An electric apparatus comprising:

a housing containing a substrate and a pushbutton arrangement which are placed at predetermined positions within the housing, the housing having a button hole formed, wherein the pushbutton arrangement comprises:

a pushbutton switch mounted on a side of a substrate, the pushbutton switch having an actuating portion to which an external force is applied to do switch operation;

a supporting member fixed to the substrate on the same side as the pushbutton switch mounted;

a button operation member for pushing the actuating portion of the pushbutton switch; and an elastic connect member fixed to the supporting member at one end thereof and having the button operation member fixed at the other end thereof so that the button operation member is placed on the actuating portion of the pushbutton switch and is placed in the button hole of the housing.

11. The electric apparatus according to claim 10, wherein a force caused by the elastic connection member is being applied to the button operation member in a predetermined direction.

12. The electric apparatus according to claim 11, wherein the force is applied to the button operation member toward the pushbutton switch and movement of the button operation member is stopped by the actuating portion of the pushbutton switch.

13. The electric apparatus according to claim 11, wherein the button hole of the housing stops the button operation member moving in the predetermined direction.

14. The electric apparatus according to claim 10, further comprising:

an engagement mechanism for engaging the supporting member with the substrate.

15. The electric apparatus according to claim 14, wherein the elastic connection member connects to the supporting member with the button operation member in a slope in such a way that the button operation member is kept away from the substrate and the supporting member is connected to the substrate by the engagement mechanism.

16. The electric apparatus according to claim 14, wherein the elastic connection member connects the supporting member with the button operation member a way that the button operation member comes close to the substrate and the supporting member is connected to the substrate by the engagement mechanism.

17. The electric apparatus according to claim 10, wherein the housing further has a boss formed therein so that the boss supports the substrate at a position corresponding to the pushbutton switch.

18. The electric apparatus according to claim 10, wherein the pushbutton arrangement includes a plurality of pushbutton switches, wherein the button operation member and the elastic connection member are provided for each pushbutton switch.

19. The electric apparatus according to claim 10, wherein the substrate is mounted with a vibrator.

20. A mobile communication apparatus comprising:

a housing containing a substrate mounted with a vibrator for informing of incoming call and a pushbutton arrangement which are placed at predetermined positions within the housing, the housing having a button hole formed, wherein the pushbutton arrangement comprises:

a pushbutton switch mounted on a side of a substrate, the pushbutton switch having an actuating portion to which an external force is applied to do switch operation;

a boss formed in the housing, for supporting the substrate at a position corresponding to the pushbutton switch;

a supporting member fixed to the substrate on the same side as the pushbutton switch mounted;

a button operation member for pushing the actuating portion of the pushbutton switch; and an elastic connection member fixed to the supporting member at one end thereof and having the button operation member fixed at the other end thereof so that the button operation member is placed on the actuating portion of the pushbutton switch and is placed in the button hole of the housing.

* * * * *